US008011162B2

(12) United States Patent
Overby

(10) Patent No.: US 8,011,162 B2
(45) Date of Patent: Sep. 6, 2011

(54) CHAIN CONSTRUCTED STRUCTURE

(76) Inventor: Christopher Clint Overby, Four Oaks, NC (US)

( * ) Notice: Subject to any disclaimer, the term of this patent is extended or adjusted under 35 U.S.C. 154(b) by 1378 days.

(21) Appl. No.: 11/536,086

(22) Filed: Sep. 28, 2006

(65) Prior Publication Data

US 2008/0078139 A1 Apr. 3, 2008

(51) Int. Cl.
*E04B 1/00* (2006.01)

(52) U.S. Cl. ..... 52/745.17; 52/108; 52/637; 52/646; 52/653.2

(58) Field of Classification Search ..... 52/108, 52/645, 646, 633, 637, 638, 650.1–650.3, 52/655.1, 653.1, 653.2, 745.17, 745.18; 182/178.1–178.5
See application file for complete search history.

(56) References Cited

U.S. PATENT DOCUMENTS

| | | | | |
|---|---|---|---|---|
| 3,011,586 | A | 10/1961 | Harvey | |
| 3,029,913 | A | 4/1962 | Liesenfeld | |
| 3,156,329 | A | 11/1964 | Alberti | |
| 3,474,579 | A | 10/1969 | Kieser | |
| 3,656,269 | A | 4/1972 | Witschel et al. | |
| 3,672,104 | A | 6/1972 | Luckey | |
| 4,037,382 | A | 7/1977 | Jacobs | |
| 4,578,919 | A | 4/1986 | Amadon et al. | |
| 4,601,152 | A | 7/1986 | Coppa | |
| 4,619,549 | A | 10/1986 | Gilbreth | |
| 4,620,405 | A | 11/1986 | Melland | |
| 4,641,477 | A | 2/1987 | Schleck | |
| 5,163,262 | A | 11/1992 | Adams | |
| 5,307,080 | A | 4/1994 | Okumura | |
| 5,417,027 | A | 5/1995 | Wagenet | |
| 5,555,954 | A | 9/1996 | Swiderski | |
| 5,822,945 | A | 10/1998 | Muller | |
| 6,321,501 | B1 * | 11/2001 | Ignash | 52/645 |
| 6,363,956 | B2 | 4/2002 | Carter | |
| 6,520,196 | B2 | 2/2003 | Carter | |
| 6,739,098 | B2 | 5/2004 | Hoberman | |
| 6,920,722 | B2 | 7/2005 | Brown et al. | |
| 6,969,211 | B2 | 11/2005 | Altman | |
| 2002/0083675 | A1 | 7/2002 | Hoverman | |

FOREIGN PATENT DOCUMENTS

| | | |
|---|---|---|
| WO | 00/43708 | 7/2000 |

* cited by examiner

*Primary Examiner* — William V Gilbert
(74) *Attorney, Agent, or Firm* — Coats and Bennett, PLLC

(57) ABSTRACT

A collapsible support structure includes a plurality of linked, inter-connectable segments that allow the structure to transform between a rigid structure and a flexible chain. The chain is generally extendible in a first direction while the rigid structure extends in a transverse second direction. At least a first linked segment is connectable with a second linked segment that is not immediately adjacent to the first segment within the chain. The chain may be converted to the rigid structure by wrapping the chain about an axis extending in the second direction. The segments may include an overall height and further include a coupling that is connected to an adjacent segment. The coupling may be disposed so that the adjacent segment is offset about $1/N^{th}$ of the overall height. With this coupling, the first segment may be connectable with the second segment that is N segments separated from the first segment.

23 Claims, 12 Drawing Sheets

CHAIN CONSTRUCTED STRUCTURE

BACKGROUND

Support structures are erected to provide a temporary or permanent framework on which to support various items. For example, items such as lighting, antennas, or other electrical or mechanical equipment, may be secured in different positions using such support structures. Furthermore, support structures may themselves serve a primary function of supporting workers or equipment, such as in the case of scaffolding. Regardless of the application, the support structure occupies a volume in order to offer strength and stability to the structure. Unfortunately, this same volume tends to make cumbersome the storage and transportation of the support structure.

Collapsible support structures are known, but often consist of detachable components that are individually attached during assembly and removed during disassembly. Accounting for each of the individual components during assembly, disassembly, storage, or transportation tends to be cumbersome. Another drawback of some conventional collapsible support structures is that where significant heights or spans are required of the structure, the collapsible components of the structure may include a significant length. Thus, storage and transportation of the lengthy components also tends to be cumbersome. Accordingly, conventional structures may not adequately solve the need for efficient storage and/or transportation of the structure when not in use.

SUMMARY

Embodiments of the present invention are directed to a collapsible support structure that includes a plurality of linked, inter-connectable segments that allow the structure to transform between a rigid structure and a flexible chain. The chain is generally extendible in a first direction while the rigid structure extends in a transverse second direction. At least a first linked segment is connectable with a second linked segment that is not immediately adjacent to the first segment within the chain. The chain may be converted to the rigid structure by wrapping the chain about an axis extending in the second direction. The segments may include an overall height and further include a coupling that is connected to an adjacent segment. The coupling may be disposed so that the adjacent segment is offset about $1/N^{th}$ of the overall height. With this coupling, the first segment may be connectable with the second segment that is N segments separated from the first segment.

In one embodiment, the linked segments are substantially triangular. The segments may include a male connection that couples to a female connection on the second segment. Further, each segment may include its own second female connection that couples to a second male connection on a third linked segment that is not immediately adjacent to the first segment. During the conversion between a chain and a rigid structure, the male connection may engage the female connection through a lateral opening at the female connection. The support structure may implement a locking feature to maintain the interface between the male connection and the female connection. In one embodiment, the triangle-shaped segments may include a tube establishing a long side of the triangle. The linked segments may include a male connection disposed at a first end of the long side of the triangle and a female connection disposed at an opposite second end of the long side of the triangle.

DETAILED DESCRIPTION

Figure 1:
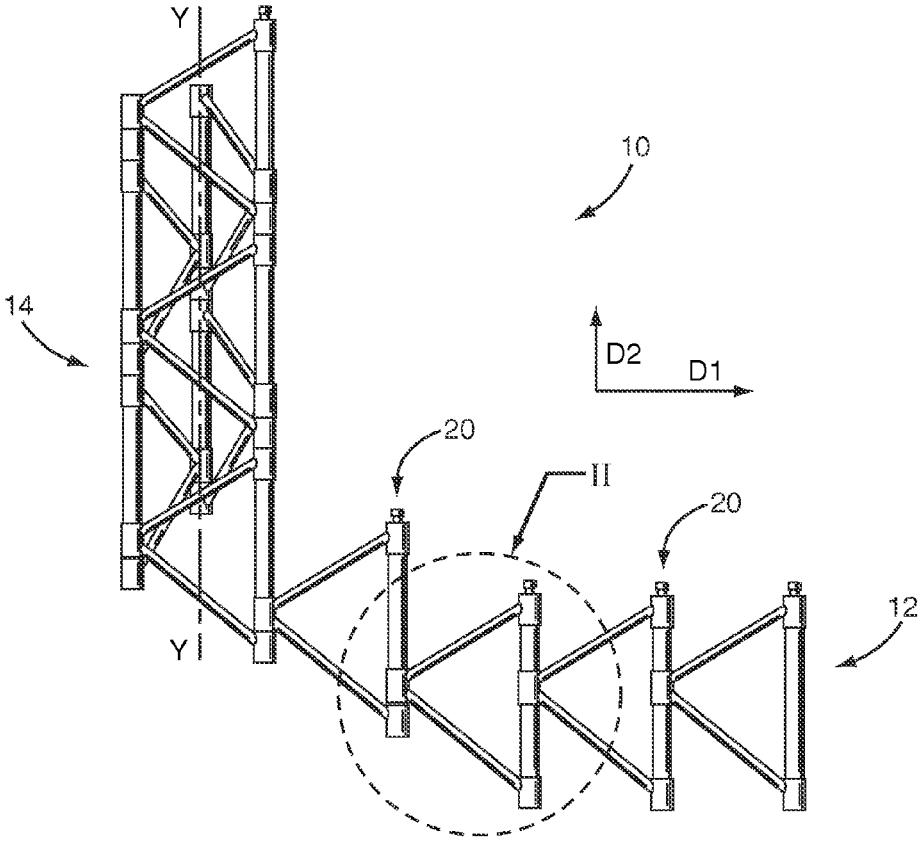
FIG. 1 is a side view of a collapsible support structure according to one embodiment.

The various embodiments disclosed herein are directed to a collapsible support structure that includes a plurality of linked, inter-connectable segments that allow the structure to transform between a rigid structure and a flexible chain. One embodiment of a collapsible support structure 10 is illustrated in FIG. 1. The support structure 10 includes a plurality of linked segments 20. The linked segments 20 are coupled to each other to form a chain 12 as shown on the right side of FIG. 1. Advantageously, the linked segments 20 are also inter-connectable to form a rigid structure 14 as shown on the left side of FIG. 1. Notably, the chain 12 extends in a direction D1 that is transverse to direction D2 along which the rigid structure 14 extends. The chain 12 is transformed into the rigid structure 14 by wrapping the linked segments 20 of the chain 12 around axis Y, which extends in direction D2.

Figure 2:
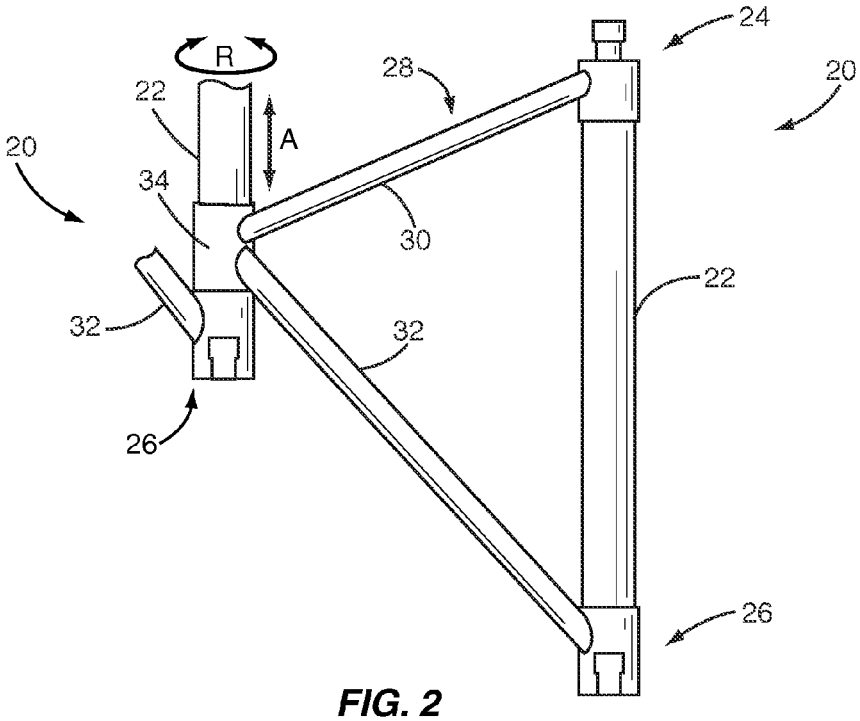
FIG. 2 is a detail view of a single segment of a collapsible support structure according to one embodiment.

FIG. 2 shows a detailed representation of a linked segment 20. In the embodiment illustrated, the linked segment 20 includes a generally triangular shape, though it should be appreciated that other shapes may be appropriate. For example, the linked segment 20 may include other shapes including for example rectangular, rounded, oblong, or T-shapes. A long side of the triangle-shaped linked segment 20 may be referred to herein as the downtube 22. Male and female connections 24, 26 are disposed at opposite ends of the downtube 22. A collar 34 is laterally offset from the downtube 22 opposite an intermediate portion 28. In the embodiment shown, the intermediate portion 28 includes oblique arms 30, 32 that extend between the downtube 22 and the collar 34. Specifically, arm 30 extends between the male connection 24 and the collar 34 while arm 32 extends between the female connection 26 and the collar 34.

Figure 3:
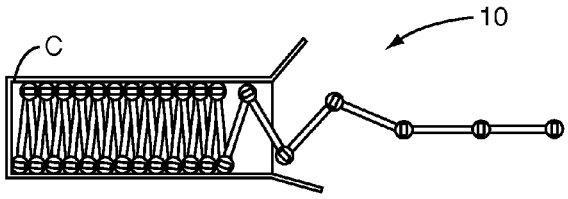
FIG. 3 is an overhead representation of a container storage for a collapsible support structure according to one embodiment.
Figure 4:
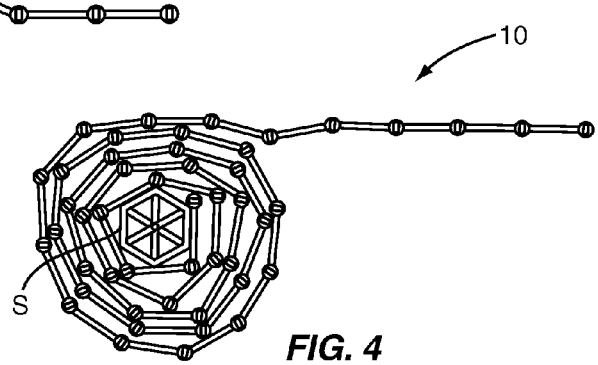
FIG. 4 is an overhead representation of a spooled storage for a collapsible support structure according to one embodiment.

The collar 34 is formed as a hollow cylindrical member that encircles the downtube 22 of an adjacent linked segment 20. Thus, the collar 34 of a first linked member 20 is coupled to a downtube 22 of an adjacent linked member 20. However, this coupling is loose in the sense that the collar 34 is free to rotate and slide about the downtube 22 as indicated by the arrows labeled A and R in FIG. 2. This freedom of motion between adjacent linked segments 20 allows the support structure 10 to collapse into a confined space such as within a shipping or storage container C as shown in FIG. 3. Similarly, the support structure 10 may be reeled around a spool S as shown in FIG. 4. Thus, the support structure 10 may occupy a minimal amount of space when stored or transported.

Figure 5:
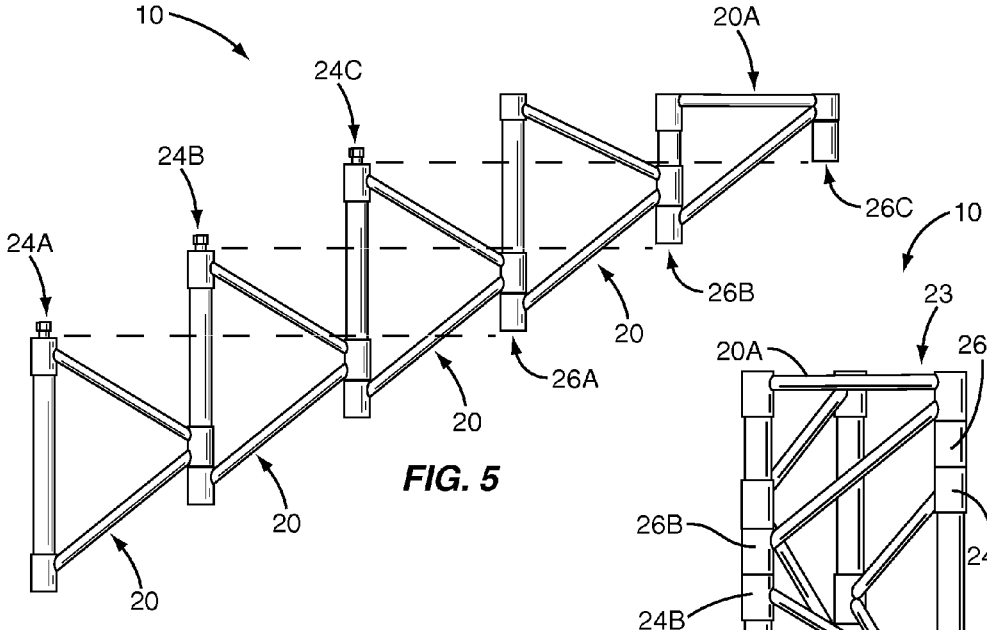
FIG. 5 is a side view of collapsible support structure extended in a chain according to one embodiment.

The male connection 24 and female connection 26 on the individual linked segments 20 are configured to engage a connection of the opposite type disposed on a different linked segment. FIG. 5 illustrates this concept. Specifically, the support structure 10 shown in FIG. 5 includes five linked segments 20, four of which 20 are similar in structure while the fifth 20A includes a truncated triangle shape. This usefulness of the truncated shape is described below.

Figure 6:
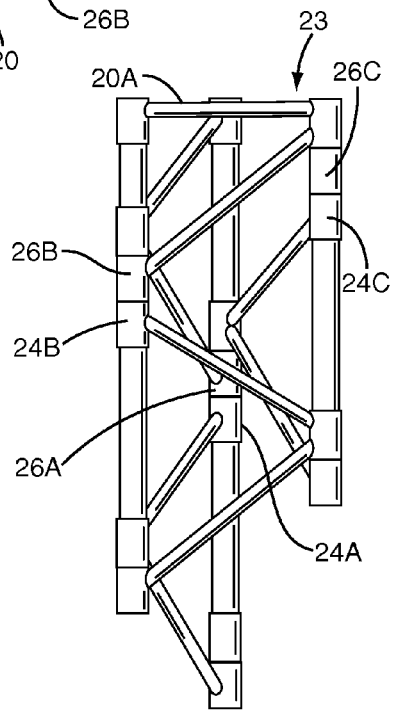
FIG. 6 is a side view of collapsible support structure erected in a rigid structure according to one embodiment.

In the illustrated example of a support structure 10, the male connections 24A-C are coupled to female connections 26A-C, respectively. These male and female connections 24A-C, 26A-C are coupled by wrapping the links in a circular manner to bring the connections 24A-C, 26A-C into communication with each other. The dashed lines in FIG. 5 illustrate that in each instance, the male connection 24A-C is coupled to a female connection 26A-C of a different link 20, 20A. The assembled support structure 10 is illustrated in FIG. 6. The resulting structure is a three-sided structure 10. Note also that the end 23 of the structure 10 is flat due to the truncated segment 20A, thereby allowing the structure 10 to abut a flat surface.

Figure 7:
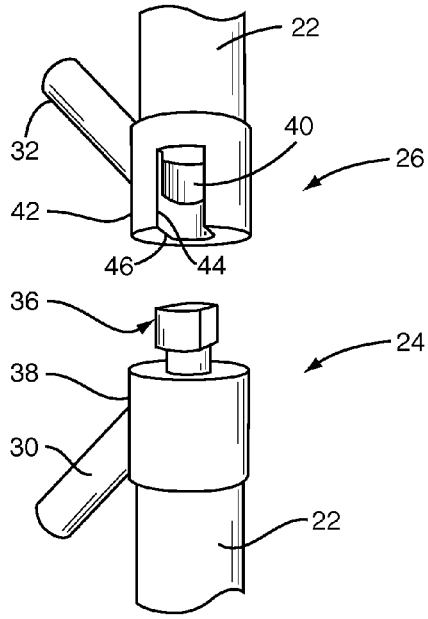
FIG. 7 is a perspective view of a representative male-female connection used in erecting a rigid structure from the collapsible support structure according to one embodiment.

FIG. 7 shows a detail representation of a coupling formed by a male connection 24 and a female connection 26. The male connection 24 includes a protruding head 36 that extends from a cap 38. The cap 38 fits over and is secured to the downtube 22. In one embodiment, the protruding head 36 may extend directly from the downtube 22. The female connection 26 includes a cavity 40 formed inside of a cap 40 that fits over and is secured to the downtube 22 of a different link 20. In one embodiment, the cavity 40 may be formed directly into the downtube 22. The cavity 40 is open to the outside of the cap 42 at a lateral opening 44 as well as an axial opening 46. The lateral opening 44 is sized to accept the protruding head 36 during assembly of the structure 10. The protruding head 36 and cavity 40 engage one another in the manner shown in FIGS. 8 and 9.

Figure 8:
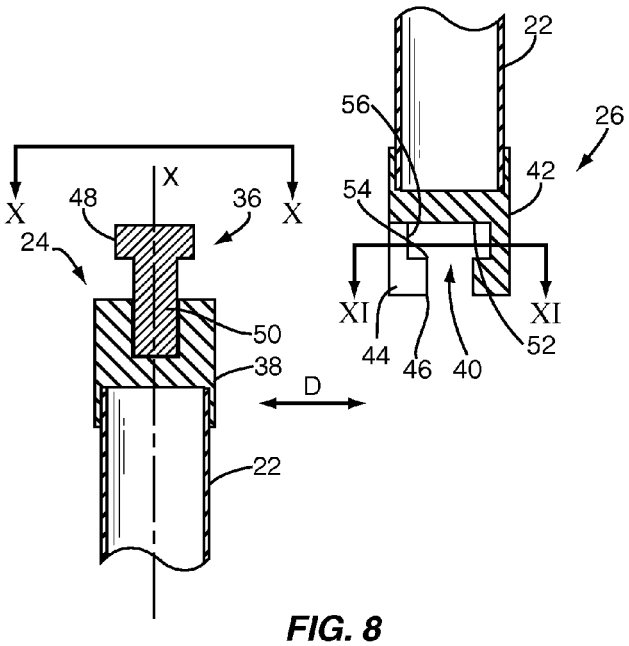
FIG. 8 is a side section view of a representative male-female connection used in erecting a rigid structure from the collapsible support structure according to one embodiment.

FIG. 8 shows a cross section view of the male connection 24 and female connection 26. The protruding head 36 includes an enlarged end 48 formed at the end of a stem 50 that is coupled to the end cap 38 at the end of the downtube 22. In the embodiment shown, the protruding head 36 and downtube 22 are aligned along a common longitudinal axis X. In other embodiments, the protruding head 36 may be offset laterally from the longitudinal axis X of the downtube 22.

Figure 9:
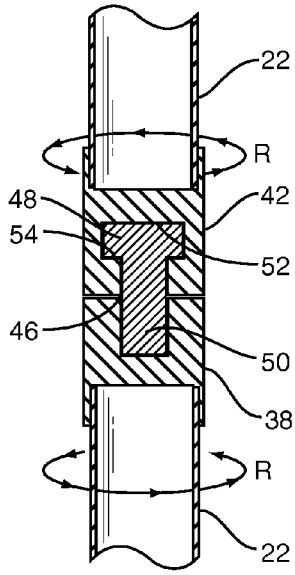
FIG. 9 is a side section view of a representative male-female connection used in erecting a rigid structure from the collapsible support structure according to one embodiment.

The cavity 40 is formed into the end cap 42 as described above. The cavity 40 includes a lateral opening 44 and an axial opening 46. The interior of the cavity 40 is formed within interior walls 56 that extend between a bearing surface 52 and a shoulder 54. The enlarged end 48 is sized to fit between the bearing surface 52 and the shoulder 54. Thus, loads from one linked segment 20 may transfer loads to a coupled linked segment 20 through the contact that is formed between the enlarged end 48 of one segment 20 and the bearing surface 52 of another segment as shown in FIG. 9.

During a transformation of the support structure 10 from a chain 12 to a rigid structure 14, the linked segments 20 are wrapped in a circular manner and moved along an adjacent downtube 22 so as to vertically align the mating male 24 and female 26 connections. As the linked segments 20 are further rotated relative to each other, the male connection 24 engages the female connection 26 from a lateral direction as indicated by the arrows labeled D. Note that this direction is substantially perpendicular to the downtube 22 axis X. The protruding head 36 enters the cavity 40 through the lateral opening 44. Once engaged, the enlarged end 48 resides between the bearing surface 52 and the shoulder 54. The stem 50 protrudes from the cavity 40 through the axial opening 46. Then, as the linked segments 20 are further rotated (arrows R) to continue the assembly of the structure 10, the additional rotation locks the protruding head 36 within the cavity 40.

Figure 10:
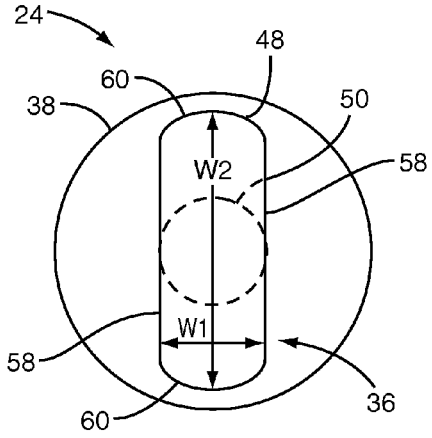
FIG. 10 is an axial view of a representative male connection used in erecting a rigid structure from the collapsible support structure according to one embodiment.
Figure 11:
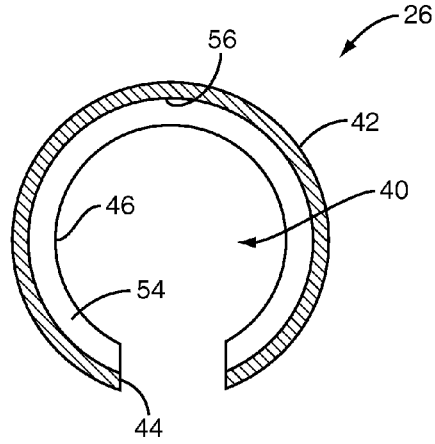
FIG. 11 is an axial section view of a representative female connection used in erecting a rigid structure from the collapsible support structure according to one embodiment.

FIGS. 10 and 11 provide axial views of the male 24 and female 26 connections, respectively, and are provided according to the view lines shown in FIG. 8. FIG. 10 shows that the protruding head 36 includes the aforementioned stem 50 and enlarged end 48. Further, the enlarged end 48 is elongated in nature with a first width W1 extending between side walls 58 and an elongated second width W2 extending between lateral walls 60. In the embodiment shown, stem 50 includes a similar width W1 as the narrow part of the enlarged head 48, though this is not expressly required. Relative to the female connection 26 shown in FIG. 11, the narrow width W1 is sized to fit within the lateral opening 44. The larger width W2 is larger than the width of the opening 44, but smaller than the width of the cavity 40 formed between the interior wall 56. Accordingly, the protruding head 36 is able to pass through the opening 44 when the enlarged end 48 is appropriately oriented. However, once the connections 24, 26 rotate relative to each other during assembly of the structure, the protruding head 36 is retained within the cavity 40.

Figure 12:
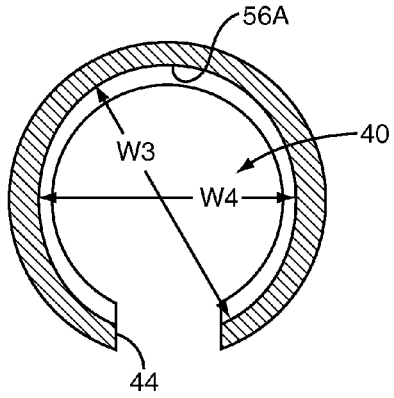
FIG. 12 is an axial section view of a representative female connection used in erecting a rigid structure from the collapsible support structure according to one embodiment.

Various locking mechanisms may be employed to help retain the protruding head 36 within the cavity. For instance, a cammed or beveled feature may be implemented to increase the friction contact between the protruding head 36 and the cavity 40. One embodiment shown in FIG. 12 shows that the interior wall 56A includes a non-circular cross section. The interior wall 56A includes an elliptical shape so that the width W3 of the cavity 40 is wider near the lateral opening 44 and narrows to a smaller width W4 as the protruding head 36 rotates within the cavity. Other surfaces may be wedged or beveled to achieve a similar effect. For instance, the bearing surface 52 or shoulder 54 may be wedge or cam shaped so that the friction contact between the protruding head 36 and the cavity 40 increases as the protruding head 36 rotates within the cavity 40.

Figure 13:
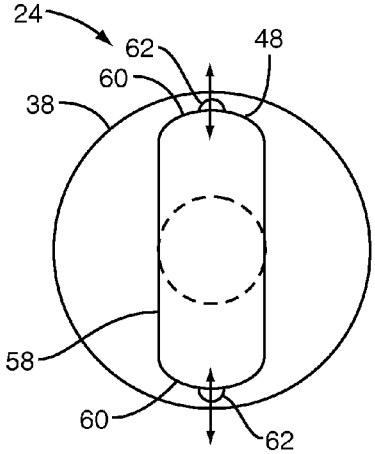
FIG. 13 is an axial view of a representative male connection used in erecting a rigid structure from the collapsible support structure according to one embodiment.
Figure 14:
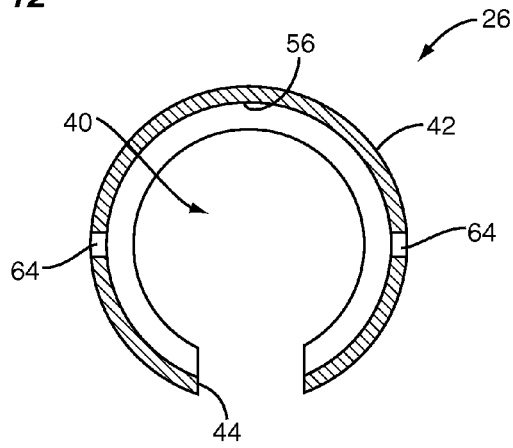
FIG. 14 is an axial section view of a representative female connection used in erecting a rigid structure from the collapsible support structure according to one embodiment.

In an embodiment shown in FIGS. 13 and 14, the enlarged end 48 includes one or more locking features 62 that engage corresponding recesses 64 in the interior wall 56 of the female connector 26. The locking features 62 may be implemented using a variety of features, including but not limited to ball plungers, expanding pegs, and biased protrusions. Generally, the locking features 62 may deflect inward and outward in the direction shown. Further, the locking features 62 may be biased outwards by a spring element (not shown). As the protruding head 36 engages the cavity, the locking features 62 may be forced inward by the interior wall 56. Then, as the protruding head 36 rotates within the cavity 40, the locking features 62 will align with the recesses 64. The locking features 62 may expand into the recesses 64 to aid in locking the protruding head 36 relative to the cavity 40.

Figure 15A:
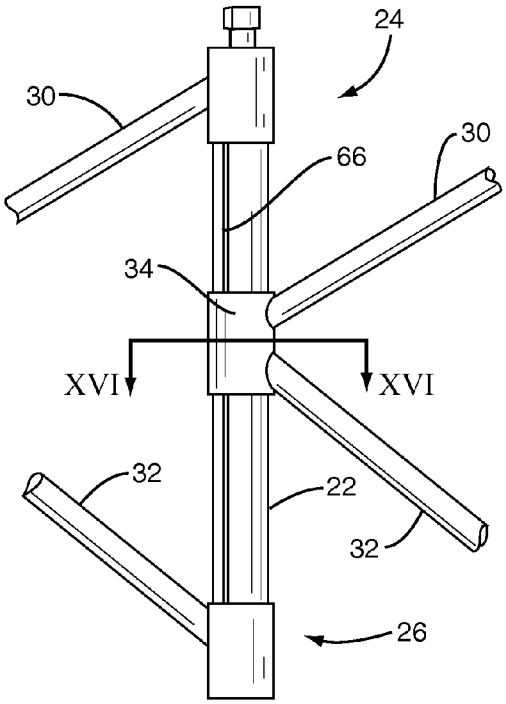
FIG. 15A is a detail side view of a coupling between adjacent segments of a collapsible support structure according to one embodiment.
Figure 15B:
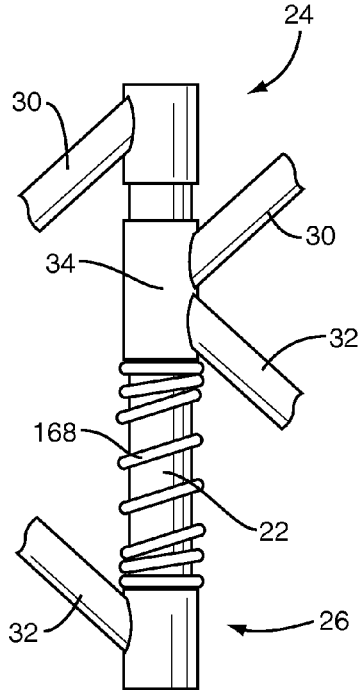
FIG. 15B is a detail side view of a coupling between adjacent segments of a collapsible support structure according to one embodiment.
Figure 16:
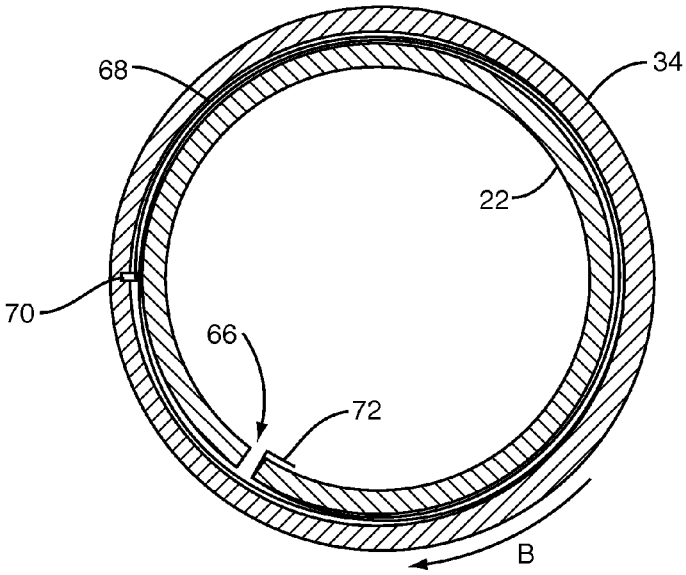
FIG. 16 is an axial section view of a coupling between adjacent segments of a collapsible support structure according to one embodiment.

Another locking mechanism is shown in an embodiment depicted in FIGS. 15A and 16. FIG. 15 shows a connection between a collar 34 of a first linked segment 20 and a downtube 22 of a second linked segment 20. As indicated above, the collar 34 is free to rotate and slide up and down on the downtube 22. A cross section of the interface between the collar 34 and downtube 22 is provided in FIG. 16 and is shown according to the section lines depicted in FIG. 15A. In this embodiment, the downtube 22 includes a slot 66 extending along the length of the downtube 22A. The slot 66 is included to retain a first end 72 of a biasing spring 68 that is coiled around the downtube 22, within the collar 34, and operates to bias the collar 34 in the direction of the arrow labeled B. A second end 70 of the biasing spring 68 is secured to the collar 34 so that the spring 68 travels with the collar 34 during relative sliding motion between the collar 34 and the downtube 22. In one embodiment, the biasing force provided by the spring 68 tends to push the linked segments 20 towards the assembled position to improve the ease with which one may build the rigid structure 14. In one embodiment, the biasing force tends to push the linked segments 20 towards the disassembled position.

Another biasing mechanism is shown in an embodiment depicted in FIG. 15B, which shows a connection between a collar 34 of a first linked segment 20 and a downtube 22 of a second linked segment 20. In this embodiment, a coil spring 168 is disposed around the downtube 22 and is positioned to urge the collar 34 in the upward direction. In another embodiment, the spring 168 may be disposed to bias the collar 34 in a downward direction. In one embodiment, the biasing force provided by the spring 168 tends to push the linked segments 20 towards the assembled position to improve the ease with which one may build the rigid structure 14. In one embodiment, the biasing force tends to push the linked segments 20 towards the disassembled position.

Figure 17:
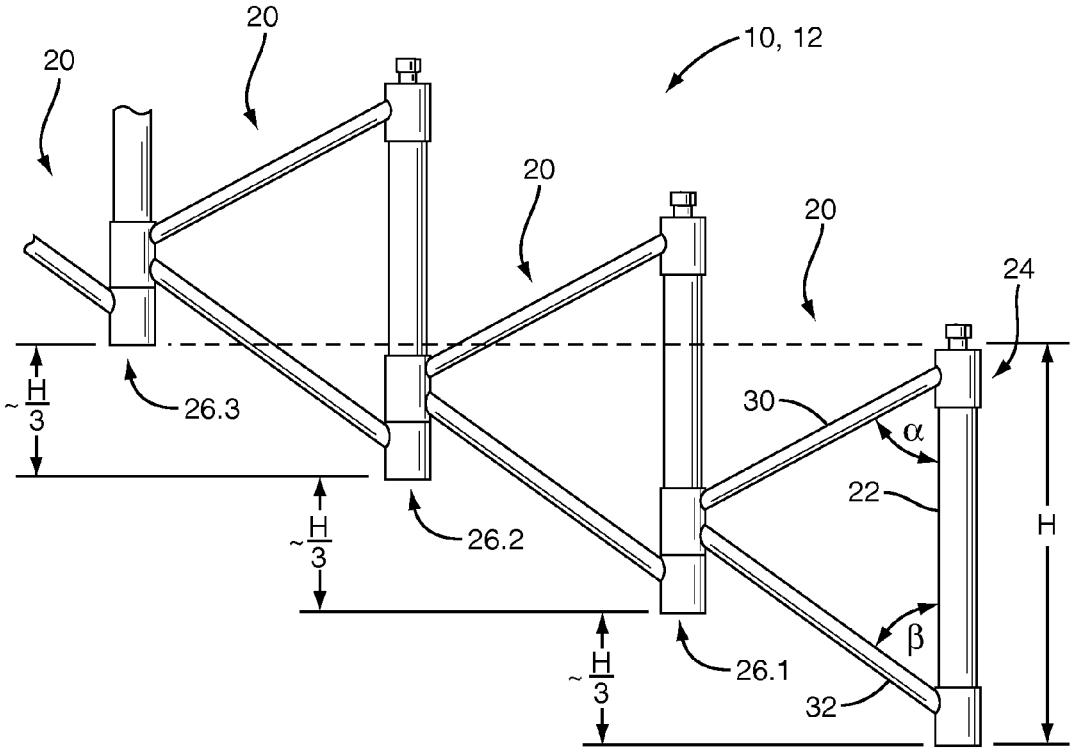
FIG. 17 is a side view of collapsible support structure with a 1:3 ratio extended in a chain according to one embodiment.
Figure 18:
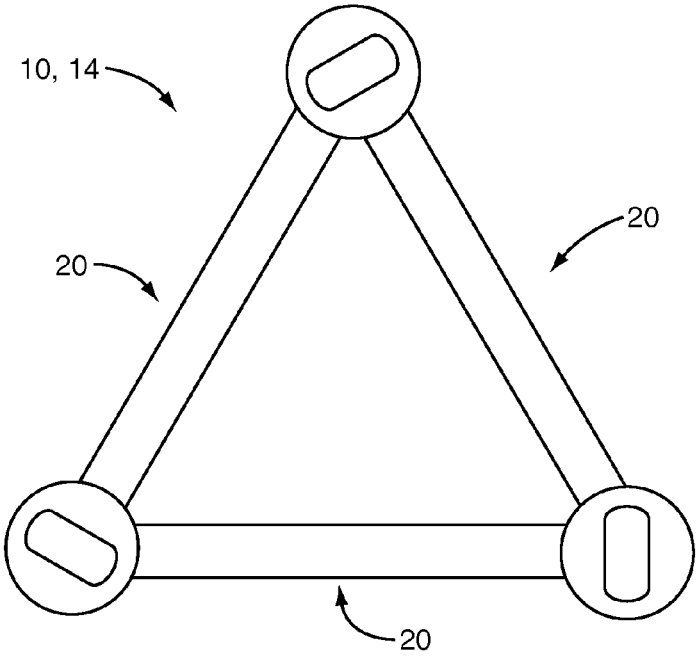
FIG. 18 is a top view of collapsible support structure with a 1:3 ratio erected in a rigid structure according to one embodiment.

The embodiments described above have implemented a 1:3 ratio, meaning each successive linked segment 20 in the chain 12 wraps around the rigid structure 14 to increase the length of the structure by about ⅓ the height of a single linked segment 20. This configuration is depicted in the embodiment shown in FIGS. 17 and 18. Particularly, the dashed line in FIG. 17 shows that the male connector 24 in the right-most linked segment 20 couples with the female connector 26.3 that is three linked segments 20 away. The number of linked segments 20 that exist between coupled connectors 24, 26 is established in part by the aforementioned 1:3 ratio, which in turn, is established in part by the relative height of the collar 34 relative to the overall height H of the linked segment 20. The height of the collar 34 relative to the overall height establishes that adjacent links are displaced approximately H/3 relative to the first link. Note that the relative position of the collar 34 is also established in part by the relative angles $\alpha$, $\beta$ between the oblique arms 30, 32 and the downtube. With this configuration, the resulting rigid structure 14 (shown in FIG. 18) includes three sides.

Figure 19:
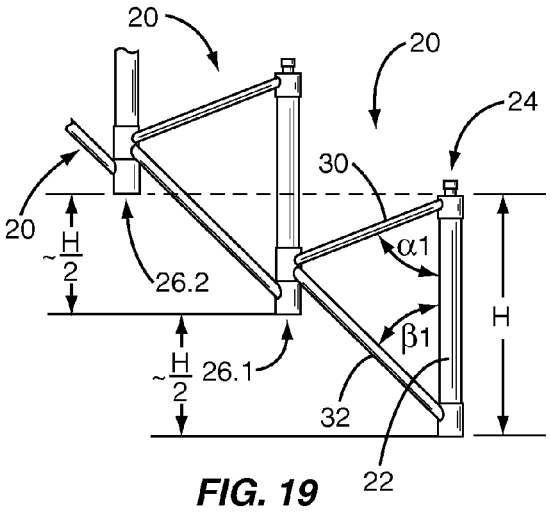
FIG. 19 is a side view of collapsible support structure with a 1:2 ratio extended in a chain according to one embodiment.
Figure 20:
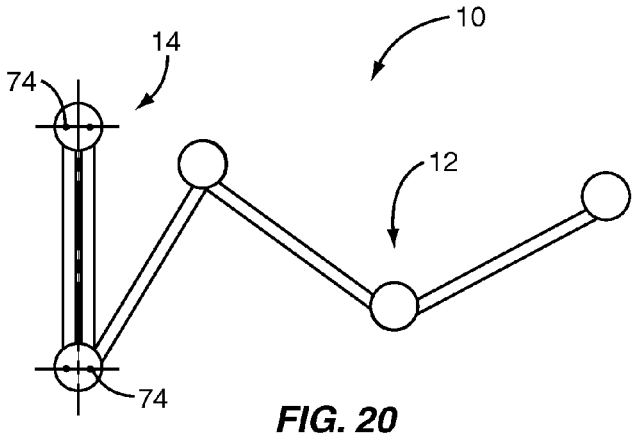
FIG. 20 is a top view of collapsible support structure with a 1:2 ratio erected in a rigid structure according to one embodiment.
Figure 21:
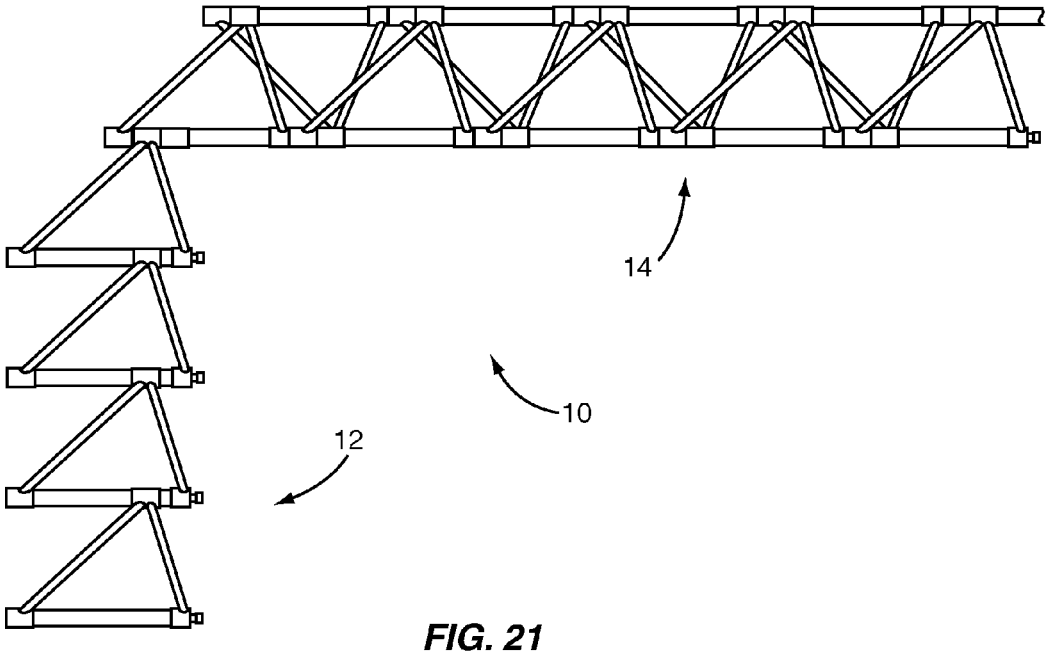
FIG. 21 is a side view of collapsible support structure with a 1:2 ratio erected in a rigid structure according to one embodiment.

The embodiment shown in FIGS. 19, 20, and 21 implements a 1:2 ratio, meaning each successive linked segment 20 in the chain 12 wraps around the rigid structure 14 to increase the length of the structure by about ½ the height of a single linked segment 20. Particularly, the dashed line in FIG. 19 shows that the male connector 24 in the right-most linked segment 20 couples with the female connector 26.2 that is two linked segments 20 away. The 1:2 ratio is established in part by the relative height of the collar 34 relative to the overall height H of the linked segment 20. In this embodiment, adjacent links are displaced approximately H/2 relative to the first link. Note that the relative position of the collar 34 in this embodiment is also established in part by the different relative angles α1, β1 between the oblique arms 30, 32 and the downtube 22. With this configuration, the resulting rigid structure 14 (shown in FIG. 18) includes three sides. In this particular embodiment, the male and female connectors 24, 26 are offset relative to the longitudinal axis X of the down tube 22. These offset connection points 74 are identified in FIG. 20. To achieve this offset connection, the protruding head 36 and corresponding cavity 40 are offset an appropriate amount to allow the 2-sided rigid structure 14 shown.

Figure 22:
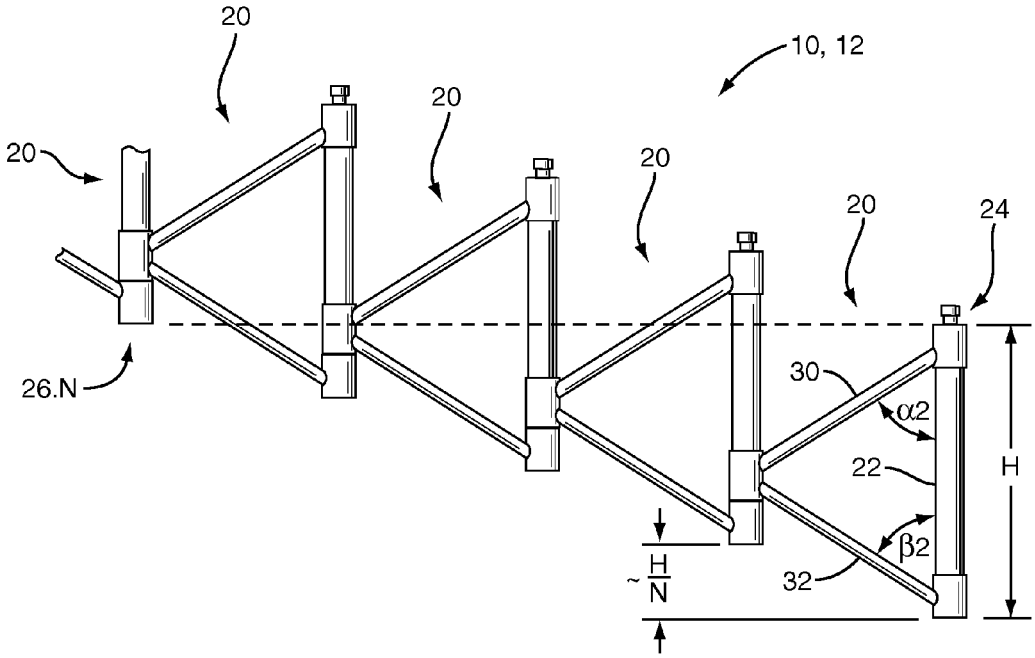
FIG. 22 is a side view of collapsible support structure with a 1:4 ratio extended in a chain according to one embodiment.
Figure 23:
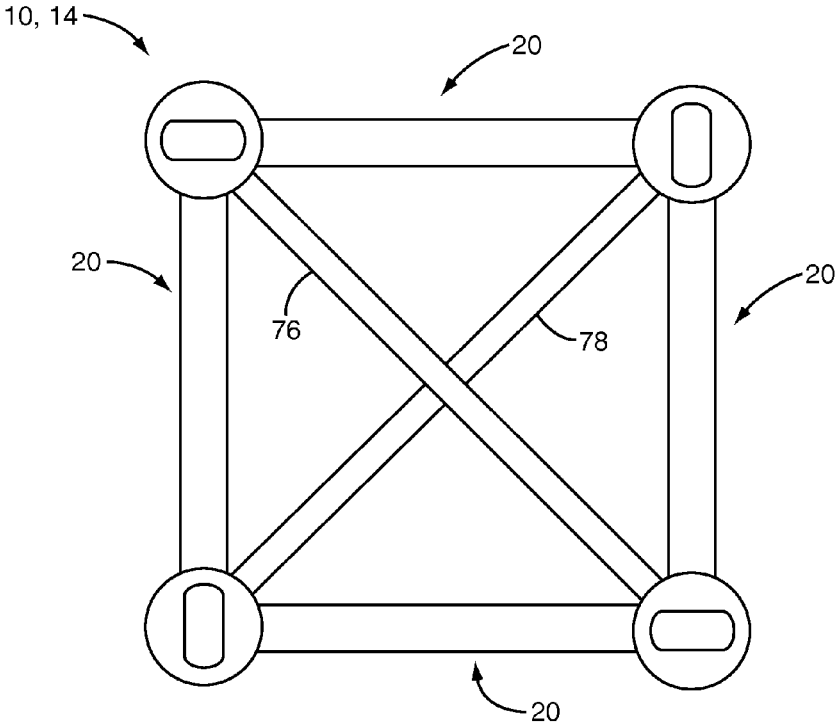
FIG. 23 is a top view of collapsible support structure with a 1:4 ratio erected in a rigid structure according to one embodiment.
Figure 24:
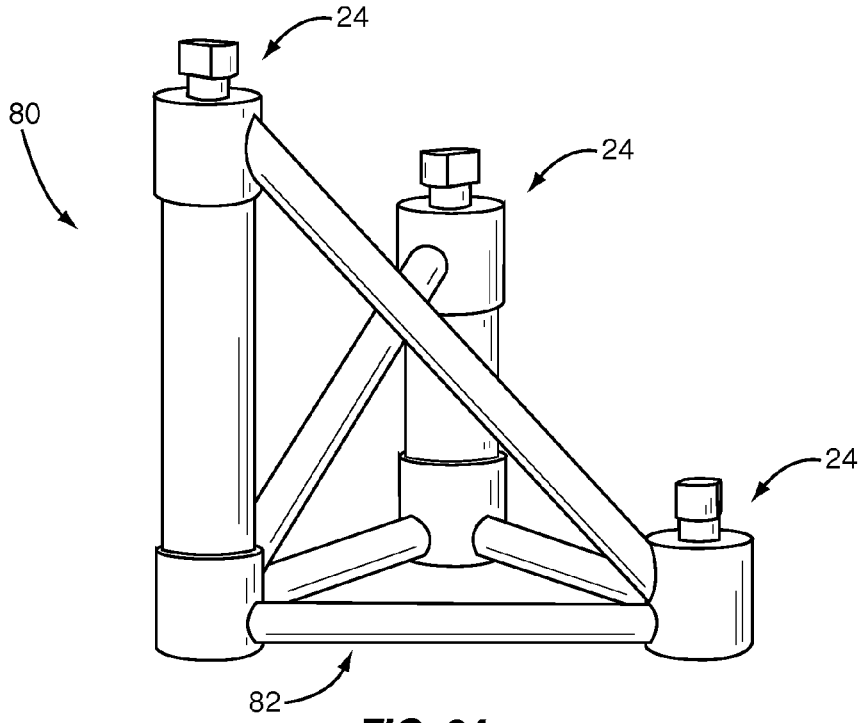
FIG. 24 is a perspective view of an end member that may be used in conjunction with a collapsible support structure according to one embodiment.

Other embodiments may use different ratios. Generally, the ratio is determined by the relative position of the collar 34 relative to the overall height of the linked segment 20. For example, the embodiment shown in FIGS. 22 and 23 implements a 1:4 ratio, meaning each successive linked segment 20 in the chain 12 wraps around the rigid structure 14 to increase the length of the structure by about ¼ the height of a single linked segment 20. The dashed line in FIG. 22 shows that the male connector 24 in the right-most linked segment 20 couples with the female connector 26.4 that is four linked segments 20 away. A general method of describing this relationship is that for a 1:N ratio, a male connector 24 couples with a female connector 26 that is N linked segments 20 away. As with other embodiments, the 1:N ratio shown in FIGS. 22, 23 is established in part by the relative height of the collar 34 relative to the overall height H of the linked segment 20. Adjacent links are displaced approximately H/N relative to the first link. Note that the relative position of the collar 34 in this embodiment is also established in part by the different relative angles α2, β2 between the oblique arms 30, 32 and the downtube 22. With this configuration, the resulting rigid structure 14 (shown in FIG. 23) includes four sides. For ratios below 1:3, the rigid structure 14 may include cross-linking members 76, 78 to provide additional structural support and stability. The cross-linking members 76, 78 may include a similar length to create a square rigid structure 14. The cross-linking members 76, 78 may include a different length to create a diamond rigid structure 14.

The linked support structure 10 may be used in conjunction with other components to increase the utility and applicability of the rigid structure 14. FIGS. 5 and 6 depicted an embodiment with a truncated linked segment 20 that produces a flat end 23, which allows the rigid structure 14 to abut a flat surface. In another embodiment, an end member 80 may be used in conjunction with a 1:3 ratio structure 10. The three male connections 24 are fixed and pre-positioned to engage corresponding female connections 26 in a linked structure 10. Notably, the bottom 82 of the end member 80 is flat to abut a flat surface. For example, a linked structure 10 coupled to this end member 80 may be erected vertically from a flat surface. In another embodiment, the end member 80 may include fixed female connections 26 to engage corresponding male connections 24 in a linked structure 10.

Figure 25:
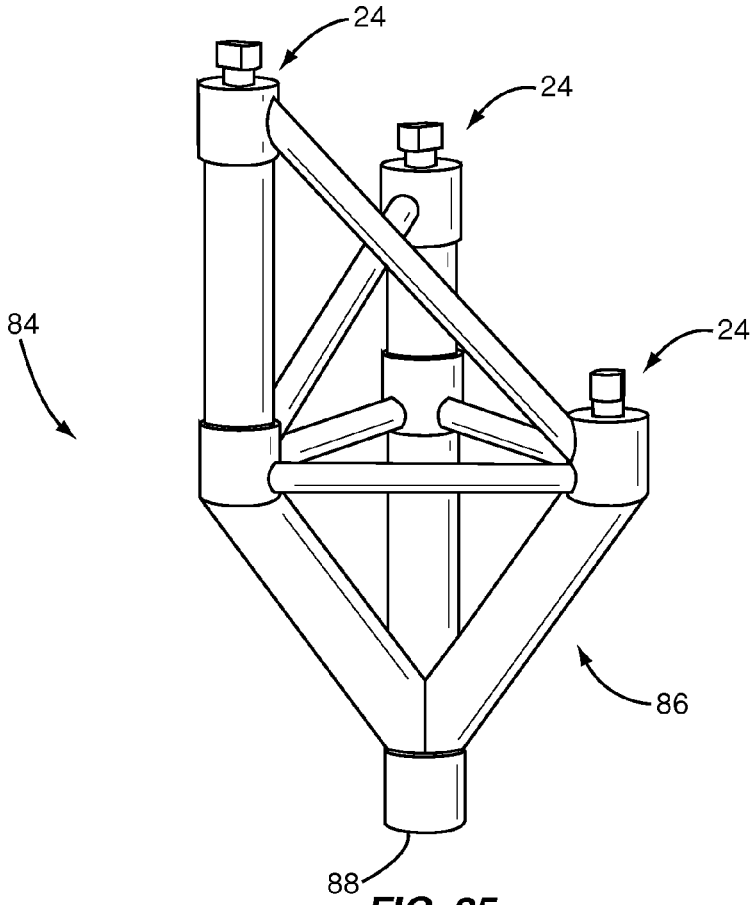
FIG. 25 is a perspective view of an end member that may be used in conjunction with a collapsible support structure according to one embodiment.

Another end member 84 shown in FIG. 25 is also adapted for use with with a 1:3 ratio structure 10. The three male connections 24 are fixed and pre-positioned to engage corresponding female connections 26 in a linked structure 10. In this embodiment, the bottom 86 of the end member 84 tapers from the triangle formed by the male connections to a cylindrical end 88 that can be coupled to a pole or inserted into the ground. In another embodiment, the end member 84 may include fixed female connections 26 to engage corresponding male connections 24 in a linked structure 10.

Figure 26:
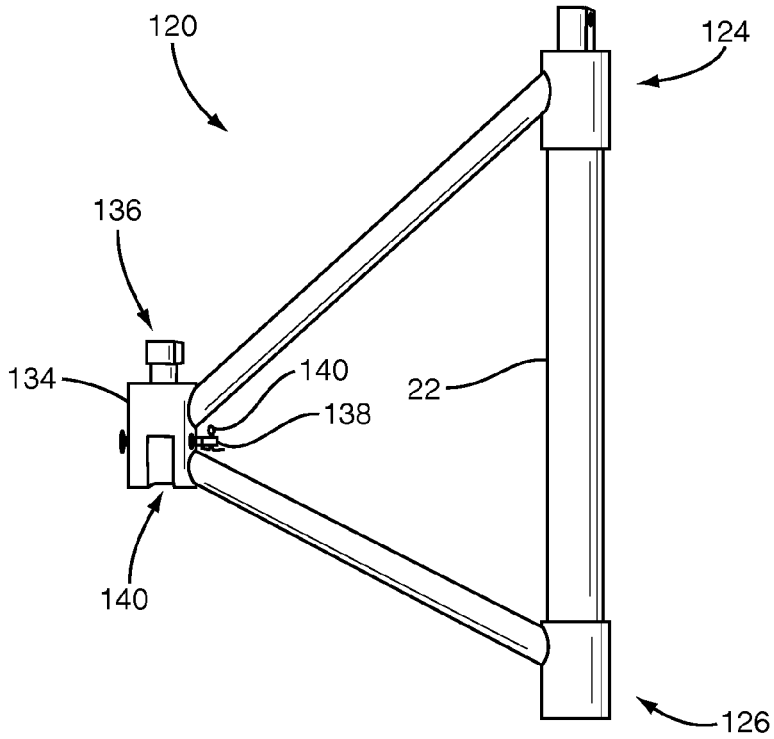
FIG. 26 is a side view of non-linked segment that may be used in conjunction with a collapsible support structure according to one embodiment.

The linked structure 10 may be used in conjunction with non-linked segments 120 such as that shown in FIG. 26. The non-linked segment 120 may include an overall size and shape that is similar to that of the linked segments 20. One or more non-linked segments 120 may be attached to a rigid structure 14 formed from a linked structure 10 to extend the overall length of the rigid structure 14 a desired amount. The non-linked segment 120 may include a downtube 22 and male 124 and female 126 connectors similar to the linked segments 20. However, since the non-linked segment 120 is not coupled to other segments 20, the non-linked segment 120 does not include a collar 34. Instead, a universal connector 134 is disposed laterally offset from the downtube 22. The universal connector 134 includes a protruding head 136 as well as a cavity 140, each of which is configured to accept a connector 24, 26 of the opposite type. One, some, or all of the connectors 124, 126, 134 on the non-linked segment 120 may be secured to a mating connector using a locking feature such as those described above. In one embodiment, a locking pin 138 may be used to secure the non-locking segment 120 to other segments 20, 120. The locking pin 138 may itself be retained using a cotter pin 140 or other retaining feature.

Figure 27:
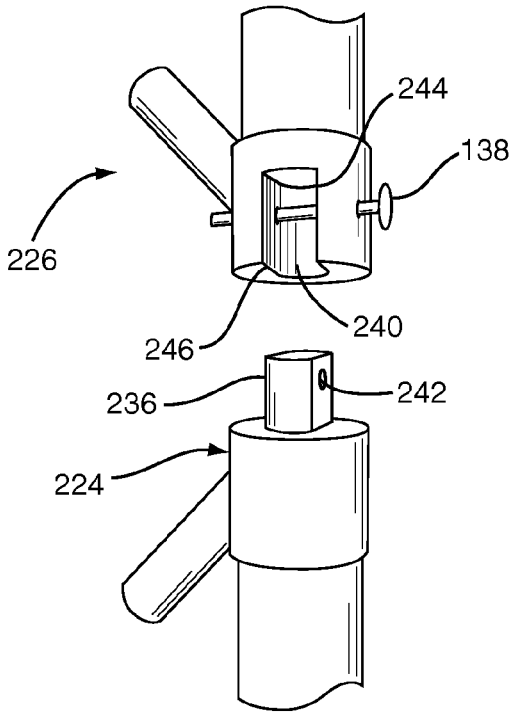
FIG. 27 is a perspective view of a representative male-female connection used in erecting a rigid structure from the collapsible support structure according to one embodiment.
Figure 28:
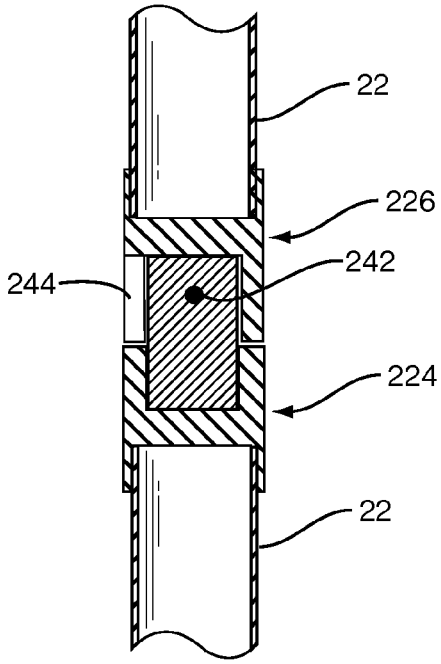
FIG. 28 is a side section view of a representative male-female connection used in erecting a rigid structure from the collapsible support structure according to one embodiment.

FIGS. 27 and 28 illustrate an exemplary connection between a male 224 and female 226 connection that may be used in either linked 20 or non-linked 120 segments. FIG. 27 offers a perspective view of the connectors 224, 226 while FIG. 28 offers a section view of the same connectors 224, 226 in a connected state. In the illustrated embodiment, the male connection 224 includes a protrusion 236 that is uniform in cross section. That is, the protrusion 236 does not have an enlarged end 48. The protrusion 236 is sized to fit within a corresponding aperture 240. In the embodiment shown, the protrusion 236 and aperture 240 are sized and shaped to prevent relative rotation of the protrusion 236 within the aperture 240. However, other embodiments may permit relative rotation of the protrusion with respect to the aperture 240. Notably, the aperture 240 includes a lateral opening 244 that allows the protrusion 236 to enter the cavity 240 from a lateral direction. Alternatively, the protrusion 236 may enter the cavity 240 axially through axial opening 246. In the embodiment shown, the connections 224, 226 are secured to each other using a pin 138 that passes laterally through the aperture 240 and through a hole 242 in the protrusion.

Figure 29:
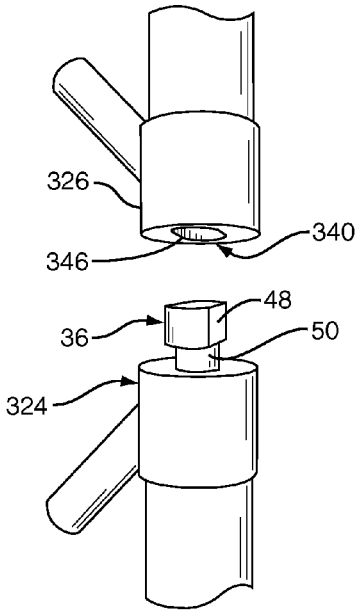
FIG. 29 is a perspective view of a representative male-female connection used in erecting a rigid structure from the collapsible support structure according to one embodiment.
Figure 30:
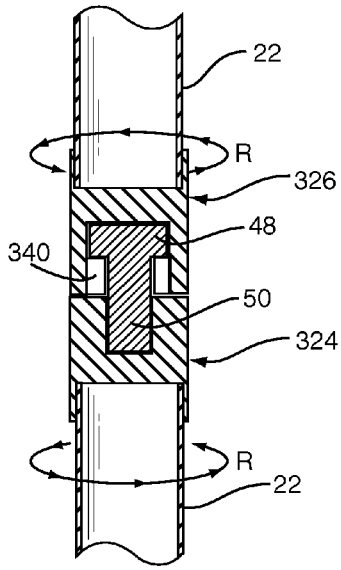
FIG. 30 is a side section view of a representative male-female connection used in erecting a rigid structure from the collapsible support structure according to one embodiment.

FIGS. 29 and 30 illustrate an exemplary connection between a male 324 and female 326 connection that may be used in either linked 20 or non-linked 120 segments. FIG. 29 offers a perspective view of the connectors 324, 326 while FIG. 30 offers a section view of the same connectors 324, 326 in a connected state. In the illustrated embodiment, the male connection 324 includes a protrusion 36 that is substantially similar to that shown and described in FIGS. 7-9. That is, the protrusion 36 includes an enlarged end 48 and a stem 50. The protrusion 36 is sized to fit within a corresponding aperture 340. In the embodiment shown, the protrusion 36 and aperture 340 are sized and shaped to allow relative rotation of the protrusion 36 within the aperture 340. However, other embodiments may restrict relative rotation of the protrusion 36 with respect to the aperture 340. Notably, the aperture 340 includes an axial opening 346 that allows the protrusion 36 to enter the cavity 340 axially through axial opening 346. In the embodiment shown, the connections 324, 326 are secured to each other by rotating the male connection 324 relative to the female connection 326 relative to each other as indicated by the arrows labeled R.

Figure 31:
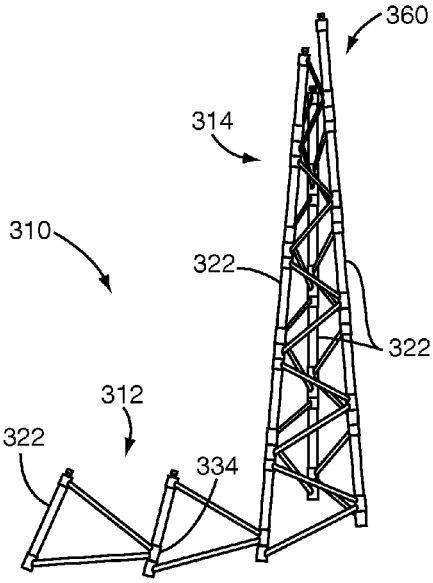
FIG. 31 is a side view of collapsible support structure with non-parallel segments erected in a rigid structure according to one embodiment.

In embodiments of the linked segments 20 described above, the collar 34 has been oriented substantially parallel to the downtube 22. As a result, the rigid structure 14 is built up with the downtubes 22 substantially parallel to each other. In other embodiments, the collar 34 may be oriented at an angle relative to the downtube 22. For example, in the linked structure 310 shown in FIG. 31, the downtube 322 is not parallel to the collar 334. Consequently, as the structure 310 is transformed from the chain 312 to the rigid structure 314, the downtubes 322 diverge from one another. This configuration provides a broader footprint for improved stability at a first end 350 of the rigid structure 314 as compared to that at the opposite second end 360 of the rigid structure 314. This configuration is obtained by including a substantially constant angle between the downtube 322 and the collar 334. In other embodiments, the angle between the downtube 322 and collar 334 may vary.

Figure 32:
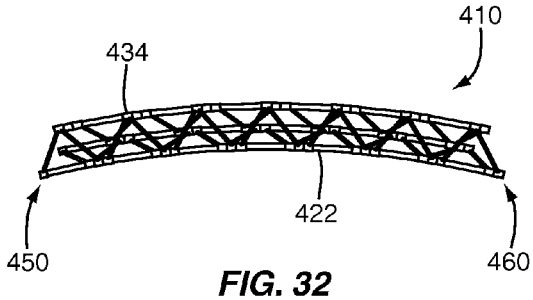
FIG. 32 is a side view of collapsible support structure with non-parallel segments erected in a rigid structure according to one embodiment.
Figure 33:
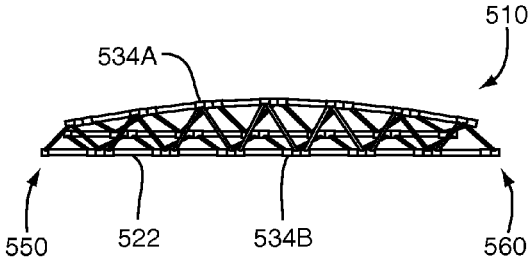
FIG. 33 is a side view of collapsible support structure with non-parallel segments erected in a rigid structure according to one embodiment.

For example, in FIG. 32, a varying angle is used between the downtube 422 and collar 434 so that the overall shape of the structure 410 curves from a first end 450 to a second end 460. In another embodiment shown in FIG. 33, some of the collars 534A are variably angled relative to the downtubes 522 while other collars 534B are substantially parallel to the downtubes 522. This configuration creates a structure 510 that includes some parallel strings of downtubes 522 and one or more curved strings of downtubes 522.

Figure 34:
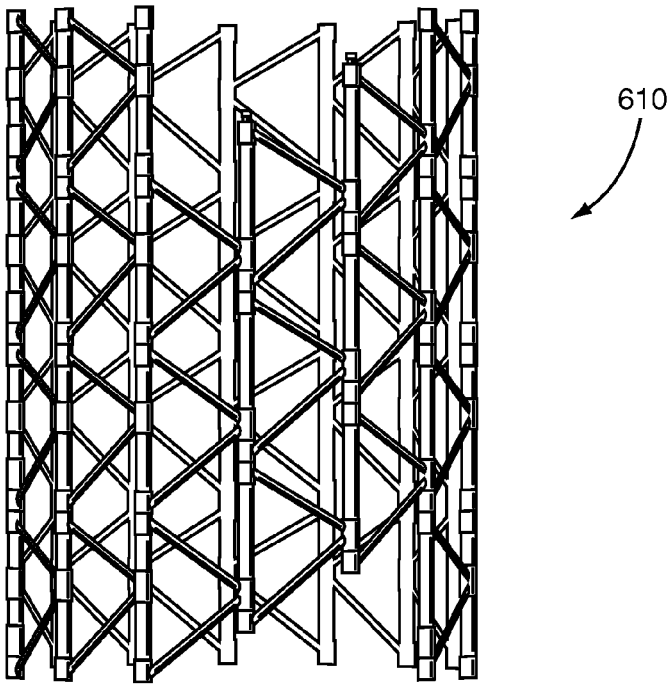
FIG. 34 is a side view of a collapsible support structure where one or more chains of linked segments are joined together to form a cylindrical wrap according to one embodiment.
Figure 35:
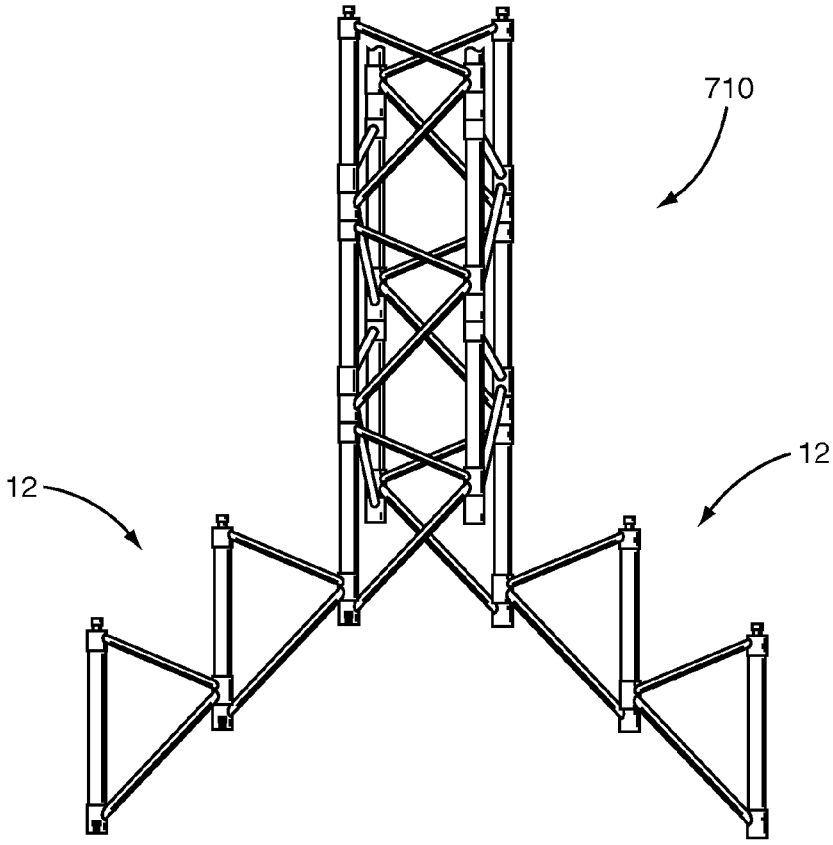
FIG. 35 is a side view of a four-sided structure that is formed from two interconnected chains of linked segments according to one embodiment.

It is worth noting that two or more chains 12 of linked segments 20 may be combined to form a single rigid structure 14. For example, FIG. 34 shows a structure 610 where one or more chains 12 of linked segments 20 are joined together to form a cylindrical wrap that may be used to support a column of liquid, sand, rock, or harvested goods. Likewise, FIG. 35 shows a four-sided structure 710 that is formed from two interconnected chains 12.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. For example, the oblique arms 30, 32 shown in the various embodiments described herein have been depicted as substantially straight. In other embodiments, these arms 30, 32 may be curved. Furthermore, each of the arms 30, 32 and downtubes 22 may have non-circular cross sections in contrast to the various embodiments shown herein. The present embodiments are, therefore, to be considered in all respects as illustrative and not restrictive, and all changes coming within the meaning and equivalency range of the appended claims are intended to be embraced therein.

What is claimed is:

1. A method of converting a collapsible support structure between a chain configuration and a rigid construct, the method comprising:

extending a plurality of at least five linked segments that are joined together in a sequence to form a chain extending along a first direction;

wrapping the chain about an erection axis extending in a second direction that is transverse to the first direction; and engaging a first linked segment of the sequence with a second linked segment of the sequence that is not adjacent to the first linked segment to form a rigid structure that extends in the second direction;

wherein the height of the sequence in the second direction is longer when formed in the rigid structure than prior to said wrapping by an amount greater than a height of any one of the linked segments.

2. The method of claim 1 wherein the step of wrapping the chain about an axis extending in a second direction that is transverse to the first direction further comprises rotating a coupling on the first segment around a tube of the second segment.

3. The method of claim 1 wherein the step of wrapping the chain about an axis extending in a second direction that is transverse to the first direction further comprises sliding a coupling on the first segment along a tube of the second segment.

4. The method of claim 1 wherein the step of connecting a first linked segment with a second linked segment comprises engaging a connection disposed at a first end of the first segment with a connection disposed at a corresponding opposite end of the second segment.

5. The method of claim 4 further comprising locking the first segment to the second segment by further wrapping the chain about the erection axis.

6. A method of converting a collapsible support structure between a chain configuration and a rigid construct, the method comprising:

joining a plurality of at least five linked segments that are coupled together to form a sequence, including a first segment having an overall height;

connecting the first segment to an adjacent second segment with a coupling that is disposed at a shorter height so that the adjacent second segment is offset about 1/Nth of the overall height;

wrapping the chain about an erection axis;

engaging the first segment of the sequence with a third segment of the sequence that is N segments separated from the first segment to form the rigid construct of the support structure extending along the erection axis;

wherein the combined height of the sequence of linked segments along the erection axis is longer when formed into the rigid construct support structure than prior to said wrapping by an amount greater than the overall height of any one of the linked segments.

7. The method of claim 6 wherein the step of wrapping the chain about an erection axis further comprises rotating the coupling of the first segment around a tube of the second segment.

8. The method of claim 6 wherein the step of wrapping the chain about an erection axis further comprises sliding the coupling of the first segment along a tube of the second segment.

9. The method of claim 6 wherein the step of connecting the first segment with the third segment comprises engaging a connection disposed at a first end of the first segment with a connection disposed at a corresponding opposite end of the third segment.

10. The method of claim 9 further comprising locking the first segment to the third segment by further wrapping the chain about the erection axis.

11. A collapsible support structure comprising:

a plurality of linked segments joined together in a sequence; the plurality of segments comprising at least five segments disposed, including a first linked segment and a second linked segment not immediately adjacent the first linked segment;

the sequence of linked segments changeable from a first configuration to a second configuration;

wherein, in the first configuration, the linked segments form a chain that extends in a first direction;

wherein, in the second configuration, the first linked segment is connected to the second linked segment to form a rigid structure that extends in a second direction that is transverse to the first direction; the first linked segment being connectable with the second linked segment upon wrapping the chain about an axis extending in the second direction;

wherein a combined height of the linked segments in the second direction is greater when in the second configuration than when in the first configuration by an amount greater than a height of any one of the linked segments.

12. The collapsible support structure of claim 11 wherein the linked segments are substantially triangular.

13. The collapsible support structure of claim 11 wherein the first linked segment includes a male connection that couples to a female connection on the second linked segment.

14. The collapsible support structure of claim 13 wherein the male connection engages the female connection through a lateral opening at the female connection that extends substantially perpendicular to the second direction.

15. The collapsible support structure of claim 13 further comprising a locking feature to maintain the interface between the male connection and the female connection.

16. The collapsible support structure of claim 11 wherein the first linked segment includes a male connection and female connection, both for engaging other linked segments of the sequence, disposed on opposing ends of the first segment in the second direction.

17. A collapsible support structure comprising:

a plurality of linked segments joined together in a sequence; the plurality of linked segments comprising at least five segments;

the plurality of segments including, a first segment including an overall height and a coupling that is connected to an adjacent second segment; the coupling being disposed at a shorter height so that the adjacent second segment is offset about 1/Nth of the overall height;

the sequence of linked segments changeable from a first configuration to a second configuration;

wherein, in the first configuration, the linked segments form a chain that extends in a first direction with the first segment disengaged from a third linked segment that is N segments separated from the first segment in the sequence;

wherein, in the second configuration, the first segment being engaged with the third linked segment to form the support structure that extends in a second direction that is transverse to the first direction;

wherein a combined height of the linked segments in the second direction is greater when in the second configuration than when in the first configuration by an amount greater than the overall height of any one of the linked segments.

18. The collapsible support structure of claim 17 wherein the linked segments are substantially triangular.

19. The collapsible support structure of claim 18 wherein the linked segments include a male connection disposed at a first end of the long side of the triangle and a female connection disposed at an opposite second end of the long side of the triangle.

20. The collapsible support structure of claim 17 wherein the first segment includes a male connection and female connection, both for engaging other linked segments of the sequence, disposed on opposing ends of the first segment in the second direction.

21. The collapsible support structure of claim 17 wherein the first segment includes a male connection that couples to a female connection on the third segment.

22. The collapsible support structure of claim 21 wherein the first segment includes a second female connection that couples to a second male connection on a fourth linked segment that is not immediately adjacent to the first segment in the first direction.

23. The collapsible support structure of claim 21 further comprising a locking feature to maintain the interface between the male connection and the female connection.

* * * * *